US007146952B2

(12) United States Patent
Kreil et al.

(10) Patent No.: US 7,146,952 B2
(45) Date of Patent: Dec. 12, 2006

(54) VALVE TAPPET SYSTEM, ESPECIALLY ANTI-ROTATION BUCKET TAPPET HAVING CURVED CAM FOLLOWER SURFACE

(75) Inventors: Franz Kreil, Piliening (DE); Gunter Schroeter, Munich (DE); Berthold Manke, Garching (DE); Franz Bonauer, Unterschleissheim (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 11/336,867

(22) Filed: Jan. 23, 2006

(65) Prior Publication Data

US 2006/0112915 A1 Jun. 1, 2006

Related U.S. Application Data

(63) Continuation of application No. PCT/EP2004/007003, filed on Jun. 26, 2004.

(30) Foreign Application Priority Data

Jul. 21, 2003 (DE) ..... 103 32 981

(51) Int. Cl.
*F01L 1/14* (2006.01)

(52) U.S. Cl. ..... 123/90.5; 123/90.48

(58) Field of Classification Search ..... 123/90.16, 123/90.39, 90.44, 90.48, 90.5; 74/569
See application file for complete search history.

(56) References Cited

U.S. PATENT DOCUMENTS

| | | | | |
|---|---|---|---|---|
| 1,401,442 | A | 12/1921 | Rausenberger | |
| 3,822,683 | A | 7/1974 | Clouse | |
| 4,876,994 | A | 10/1989 | Speil et al. | |
| 5,454,353 | A | 10/1995 | Elendt et al. | |
| 6,405,699 | B1 * | 6/2002 | Church | 123/90.5 |
| 6,474,279 | B1 * | 11/2002 | Faria | 123/90.16 |
| 2002/0124823 | A1 | 9/2002 | Faria | |

FOREIGN PATENT DOCUMENTS

| | | | |
|---|---|---|---|
| DE | 41 28 813 | A1 | 3/1993 |
| DE | 43 02 877 | A1 | 8/1994 |
| DE | 43 24 756 | C2 | 2/1995 |
| DE | 43 42 199 | A1 | 6/1995 |
| DE | 196 00 852 | A1 | 7/1997 |
| DE | 698 01 064 | T2 | 10/2001 |
| DE | 101 10 914 | A1 | 9/2002 |
| EP | 0 363 161 | A1 | 4/1990 |

(Continued)

OTHER PUBLICATIONS

Lichtenheldt, Willibald, et al., "Konstruktionslehre Der Getriebe", 1979, pp. 3-7.

International Search Report dated Nov. 4, 2004 w/English translation of relevant portion (Four (4) pages).

(Continued)

*Primary Examiner*—Ching Chang
(74) *Attorney, Agent, or Firm*—Crowell & Moring LLP

(57) ABSTRACT

A valve tappet system includes a base body, a lateral section, which forms a guide surface for guiding the base body along an oscillation axis. The anti-rotation element to suppress a rotational or swiveling movement about the oscillation axis. The anti-rotation element has a seat face which sits on the lateral section and a guide body which protrudes beyond the lateral section in the radial direction. Spaced first and second engagement protrusions are provided on the element, and the lateral section is provided with a first and second radial bores assigned to the respective first and second engagement protrusions, which are each engaged in the respective radial bore radially to the oscillation axis.

26 Claims, 4 Drawing Sheets

FOREIGN PATENT DOCUMENTS

| | | |
|---|---|---|
| EP | 0 454 518 A1 | 10/1991 |
| EP | 0 685 634 A1 | 12/1995 |
| EP | 0 857 860 B1 | 7/2001 |

OTHER PUBLICATIONS

German Search Report dated May 25, 2004 with English translation of relevant portion (four (4) pages).

* cited by examiner

VALVE TAPPET SYSTEM, ESPECIALLY ANTI-ROTATION BUCKET TAPPET HAVING CURVED CAM FOLLOWER SURFACE

This application is a continuation of international application number PCT/EP2004/007003 filed Jun. 26, 2004, and claims the benefit of priority to German patent application DE 103 32 981.1 filed Jul. 21, 2003.

BACKGROUND OF THE INVENTION

The present invention relates to a valve tappet system, in particular a bucket tappet having a cam follower surface with a convex curvature such as that which may be provided, for example, in an internal combustion engine for actuating the gas exchange valves. This invention also relates to an anti-rotation device for a valve tappet system for preventing a base body of the valve tappet system from rotating or swiveling about its axis of oscillation.

DE 43 42 199 A1 describes an anti-rotation device for a valve tappet. This valve tappet is designed as a bucket tappet and is provided with a passage at the side, i.e., in the area of the lateral surface of the tappet. A guide element formed by a spiral compression spring is inserted into this passage. The spiral compression spring is accommodated in the passage in such a way that a lateral area of the spiral compression spring protrudes radially above an outer lateral surface of the bucket tappet. In the installed position, this radially protruding section of the spiral compression spring is inserted into a guide groove provided on the cylinder head; as a linear guide element, it prevents a swiveling motion of the bucket tappet about its axis of oscillation.

DE 43 02 877 C2 describes a similar tappet in which the guide element mentioned above is designed as a cylindrical pin and is inserted laterally into a lateral surface of the tappet in the same way as the spiral compression spring.

DE 196 00 852 A1 describes an anti-rotation tappet on which the lateral area is provided with a passage into which a guide element is inserted so that a guide section of same protrudes radially beyond the lateral area. This protruding area is inserted in the installed position into a guide groove near the cylinder head, thereby preventing in a known way a rotational or swiveling motion of the tappet about its axis of oscillation.

DE 101 10 914 A1 and U.S. Pat. No. 3,822,683 disclose additional anti-rotation devices for valve tappets in which a guide element provided for preventing rotation in the circumferential direction is inserted into a passage in a lateral area of the valve tappet.

Anti-rotation device for valve tappets are necessary in particular when the cam follower surface, which comes in contact with the respective cam at least temporarily—and is actuated by the cam—is designed with a curvature, e.g., with a camber.

SUMMARY OF THE INVENTION

An object of this invention is to provide a valve tappet system which is characterized by advantageous running and operating properties and is advantageous from the standpoint of manufacturing and assembly.

This object has been achieved according to this invention by a valve tappet system having a base body, a lateral section which forms a guide surface for guiding the base body along an axis of oscillation and an anti-rotation element for suppressing a rotational or swiveling motion about the axis of oscillation. The anti-rotation element has a seat face which sits on the lateral section, a guide body which protrudes radially above the lateral section, and a first engagement protrusion and a second engagement protrusion at a distance from the former in the oscillation direction. The lateral section is provided with a first radial bore assigned to the first engagement section and a second radial bore assigned to the second engagement section, with the first engagement section like the second engagement section being inserted into the provided radial bore in a direction radial to the oscillation axis.

The present invention makes possible in an advantageous manner the ability to reliably prevent an unacceptable rotational movement of the base body about its rotation axis, whereby the lateral section is not impaired to an unacceptable extent in terms of its mechanical structure due to the coupling of the anti-rotation element with the base body which is provided according to the invention and is particularly advantageously accomplished in assembly.

The first engagement section and the second engagement section are preferably accommodated in the respective radial bores so that the anti-rotation element is coupled with the lateral section essentially without any play in both the oscillation direction and also in the circumferential direction of the lateral section. This play-free seating can be achieved in particular by configuring the engagement sections with a defined excess dimension so that they sit in the respective radial bore under a slight press fit. It is also contemplated to define the positions of the engagement sections and the radial bores in such a way that when the insertion sections are inserted into the radial bores, the result is a defined bracing, preferably a pressure bracing on the guide body.

The first engagement section and the second engagement section are currently preferably cylindrical pins or at least cylindrical pin segments. The engagement opening provided for accommodating the respective engagement section in the cylinder jacket may be bored into the lateral section of the base body in a manner that is advantageous from the standpoint of manufacturing technology. It is further contemplated to provide different diameters for the first and second insertion sections so that the anti-rotation element can be attached to the lateral section only in a certain installed position. Preferably, however, both radial bores and both engagement sections have the same diameter so that both radial bores can be bored with the same tool and the anti-rotation element can also be attached to the lateral section in such a way that it is swiveled "by 180°."

The excess or depth dimension of an area of the first or second engagement section that is elevated above the seat face and protrudes toward the axis of oscillation preferably corresponds at least to the wall thickness of the lateral section. This allows the interior surfaces of the holes provided by the radial bores to be used completely for transmission of the oscillation forces. It is also possible to provide structures, in particular peripheral edges, in the area of the radial bores so that the anti-rotation element can be secured on the lateral section.

A particularly advantageous way of fixation of the anti-rotation element on the lateral section of the bucket tappet can be achieved by fixation structures that engage behind the lateral section in the areas of the first and engagement sections. The fixation structures may be configured as catch mechanisms which are attached to an elastically yielding arm section. The arm section is preferably arranged in the radial bore provided therefore in such a way that it is inside the enveloping circle of the radial bore. It is contemplated to provide other structures, e.g., insertion form parts by way of which the catch engagement is locked and secured in the catch position. The catch engagement between the anti-rotation element and the lateral section can also be achieved with temporary elastic deformation of the anti-rotation element.

The anti-rotation element is preferably manufactured from a material having sufficient elasticity and coordinated with the base body with regard to its catch structures so that it can be clipped onto the base body.

The guide body formed by the anti-rotation element preferably has a cross section in the form of a circular segment, preferably a semicircular segment, in a plane of intersection perpendicular to the axis of oscillation.

The guide body and/or the anti-rotation element is, from a technical manufacturing standpoint, advantageously made of a plastic material. Furthermore, the valve tappet device so configured has a low mass, and favorable running and attenuation properties.

The choice of the plastic material is preferably made from the technical standpoint of materials taking into account not only thermal and mechanical load-bearing properties but in particular tribological criteria and technical vibration criteria.

The anti-rotation element is preferably coupled in a form-fitting manner to the base body in the installed position in a manner that prevents loss. The form-fitting connection of the anti-rotation element to the base body can be achieved by reshaping an end area of at least one of the engagement sections passing through the lateral section. In particular, the form-fitting connection of the anti-rotation element to the base body can be accomplished by forming a head section on each engagement section passing through the lateral section. The reshaping can be accomplished in combination with local plastification, e.g., by melting with heat.

It is also contemplated to integrally mold the anti-rotation element onto the lateral section as part of a plastic injection molding operation. The bucket tappet is preferably supported here on a mold core which has a mold cavity section for forming a head section engaging behind the lateral section. The coupling of the anti-rotation element with the lateral section can be supported by additional joining means, in particular by rivet joining.

The geometry of the anti-rotation element is preferably coordinated so that the guide body is coupled to the base body in the installed position in a loss-proof manner. The dimensions of the coupling structures between the anti-rotation element and the base body can be configured so that they ensure a form-fitting connection in the direction of oscillation and in the circumferential direction with a high margin of safety. The fixation in the radial direction may be such that only a loss-proof device is ensured for the assembly process.

The base body itself may be provided directly with the head section forming a cam contact zone. As an alternative, another tappet element, e.g., one that is selectively switchable, can be guided in the base body. The cam contact configuration preferably forms a curved cam contact surface, in particular a cambered cam contact surface in a sectional plane running radially to the camshaft axis. The valve tappet system designed in this way may be used in particular in the form of a bucket tappet in an internal combustion engine having camshafts situated at the top and valve axes inclined at an angle, i.e., not parallel to one another.

Other objects, advantages and novel features of the present invention will become apparent from the following detailed description of the invention when considered in conjunction with the accompanying drawings.

DETAILED DESCRIPTION OF THE DRAWINGS

Figure 1:
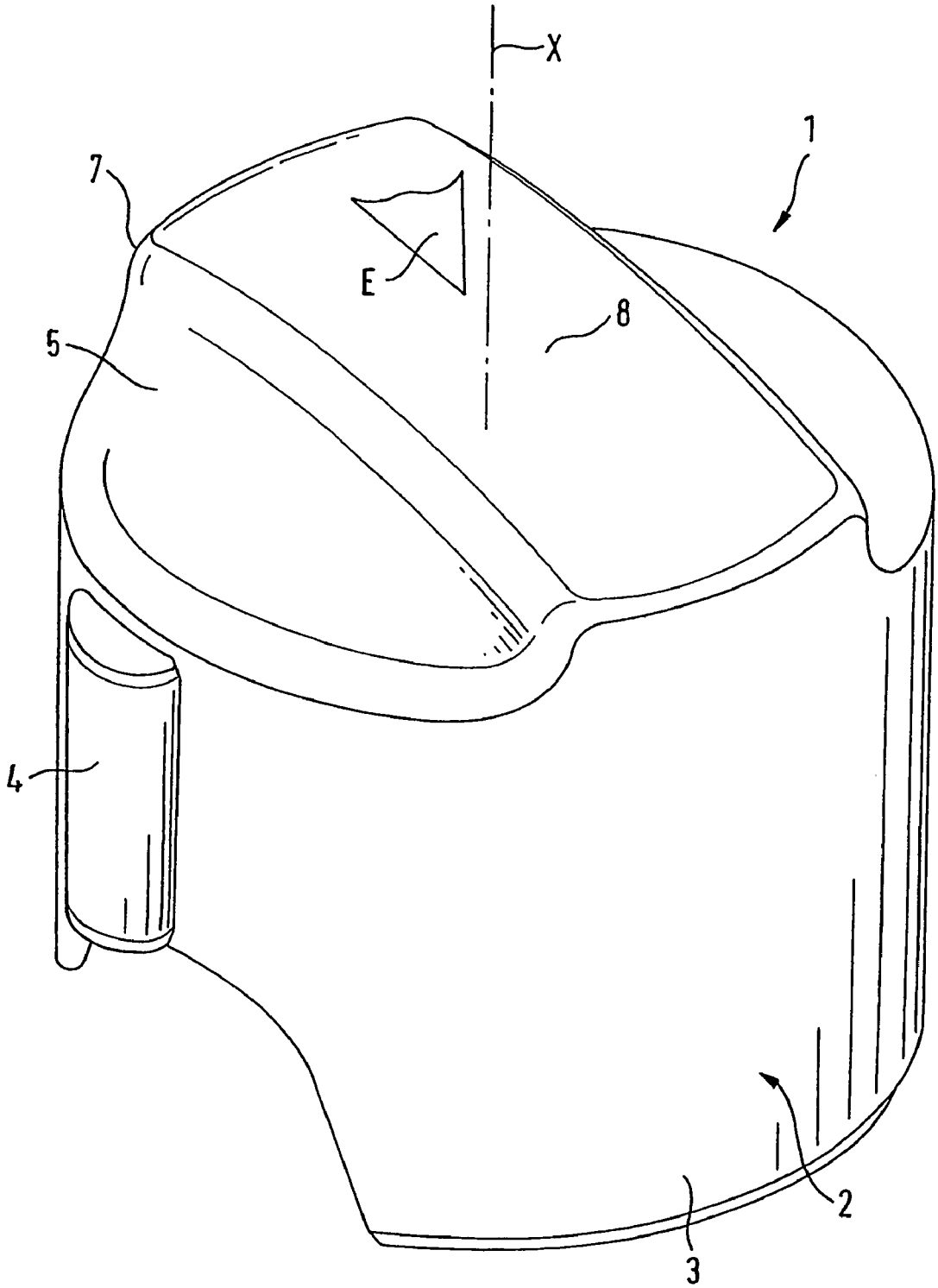
FIG. 1 is a perspective view of the valve tappet system of the present invention having an anti-rotation element and a base body.

The valve tappet system depicted in FIG. 1 includes a base body 1 whose lateral or side section 2 forms a guide face 3 for guiding the base body 1 along an oscillation axis X.

An anti-rotation element 4 is mounted on the base body 1 to suppress a rotational or swiveling movement of the base body 1 about said axis of oscillation X, the anti-rotation element forming a guide body which protrudes above the lateral section in the radial direction.

The base body 1 is provided with a head section 7. The head section 7 forms a cam contact zone 8. The cam contact zone 8 in this exemplary embodiment is designed as a cam contact surface having a cambered curvature in a radial plane E of the camshaft. The base body 1 in conjunction with the anti-rotation element 4 forms a bucket tappet system for a valve drive with the camshafts situated at the top and the valves positioned at an inclination.

Figure 3:
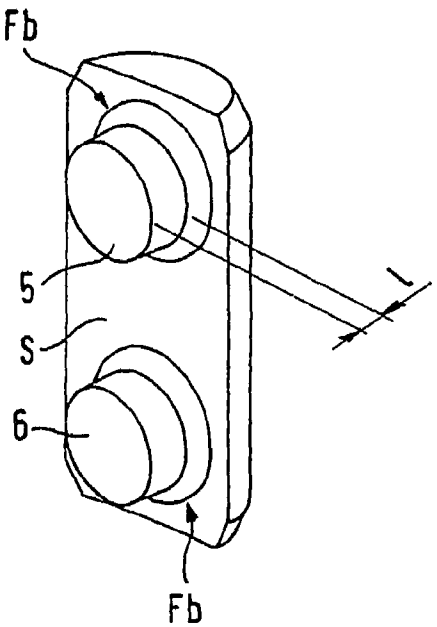
FIG. 3 is a perspective view of the anti-rotation element of the valve tappet system according to FIGS. 1 and 2.
Figure 2:
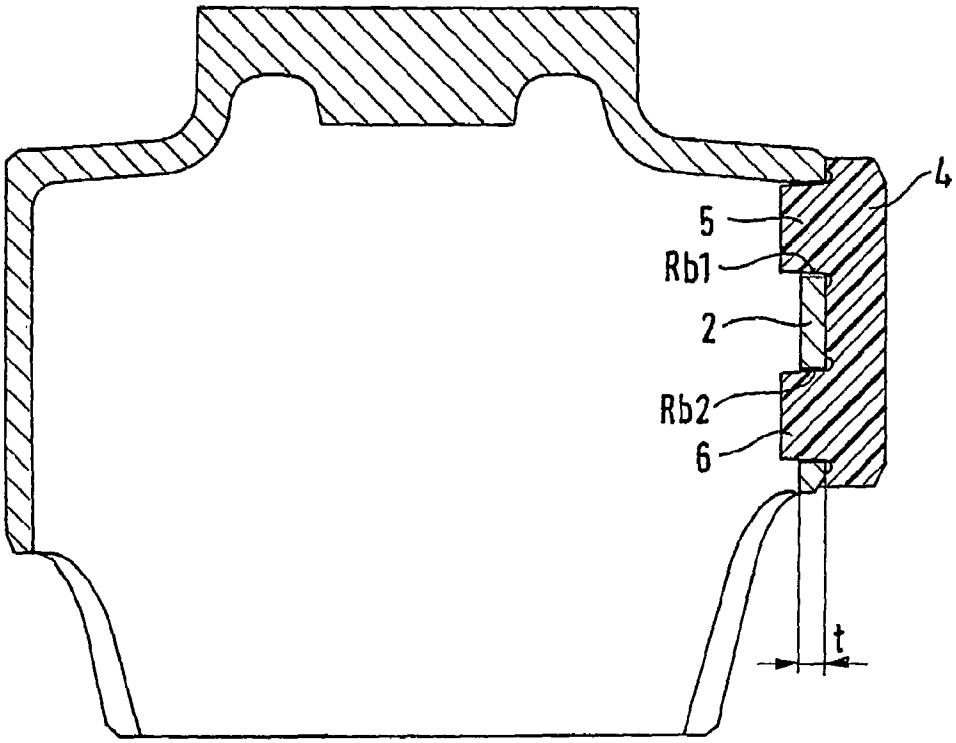
FIG. 2 is an axial sectional view through the valve tappet system according to FIG. 1 to illustrate the coupling structures.

As shown in FIGS. 2 and 3, the valve tappet systems anti-rotation element 4 includes a first engagement protrusion 5 and a second engagement protrusion 6 spaced a distance apart in the oscillation direction, and the lateral section 2 is provided with a first radial bore Rb1, which is assigned to the first engagement section 5, and with a second radial bore Rb2, which is assigned to the second engagement section 6. The first engagement section, and the second engagement section 5, 6 are each inserted into the respective assigned radial bores Rb1, Rb2 by inserting radially to the oscillation axis X.

The first engagement section 5 and the second engagement section 6 are accommodated in the respective radial bores Rb1, Rb2 in such a way that the anti-rotational element 4 is coupled to the lateral section 2 essentially without any play in both the oscillation direction and in the circumferential direction of the lateral section 2. The first and second engagement sections 5, 6 can be cylindrical pins and have a circular cross section in a sectional plane parallel to the oscillation axis X. Each of the two cylinders has the same diameter.

The excess or depth dimension I (FIG. 3) of an area of the first or second engagement sections 5, 6 that is elevated above the seat face S and protruding toward the oscillation axis X corresponds preferably at least to the wall thickness t (FIG. 2) of the lateral section 2. In the foot area Fb of the respective engagement section 5, 6, the transition to the seat surface S is such that the anti-rotation element 4 can sit reliably on the lateral section 2 with its seat face S. In this exemplary embodiment, the transition is configured as a free slot.

Figure 4:
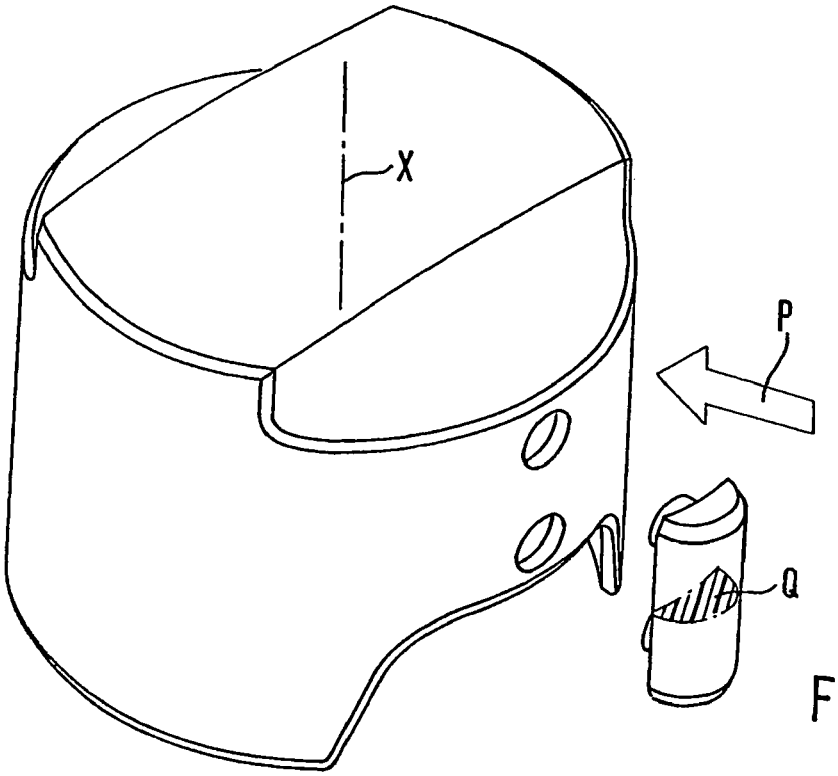
FIG. 4 is a perspective view of the bucket tappet as well as the respective anti-rotation element of the valve tappet system according to FIGS. 1 and 2.

As shown in FIG. 4, the guide body of the anti-rotation element 4 has a cross section Q in the shape of a segment of a circle in a sectional plane perpendicular to the oscillation axis X. The guide body is made of a plastic material and can be attached radially to the lateral section 2 as indicated by the arrow P. Due to the guide structures provided for guiding the bucket tappet on the cylinder head, in particular a slide groove provided to receive the anti-rotation element, the anti-rotation element is connected to the lateral section 2 in a loss-proof manner in the installed position.

Figure 5:
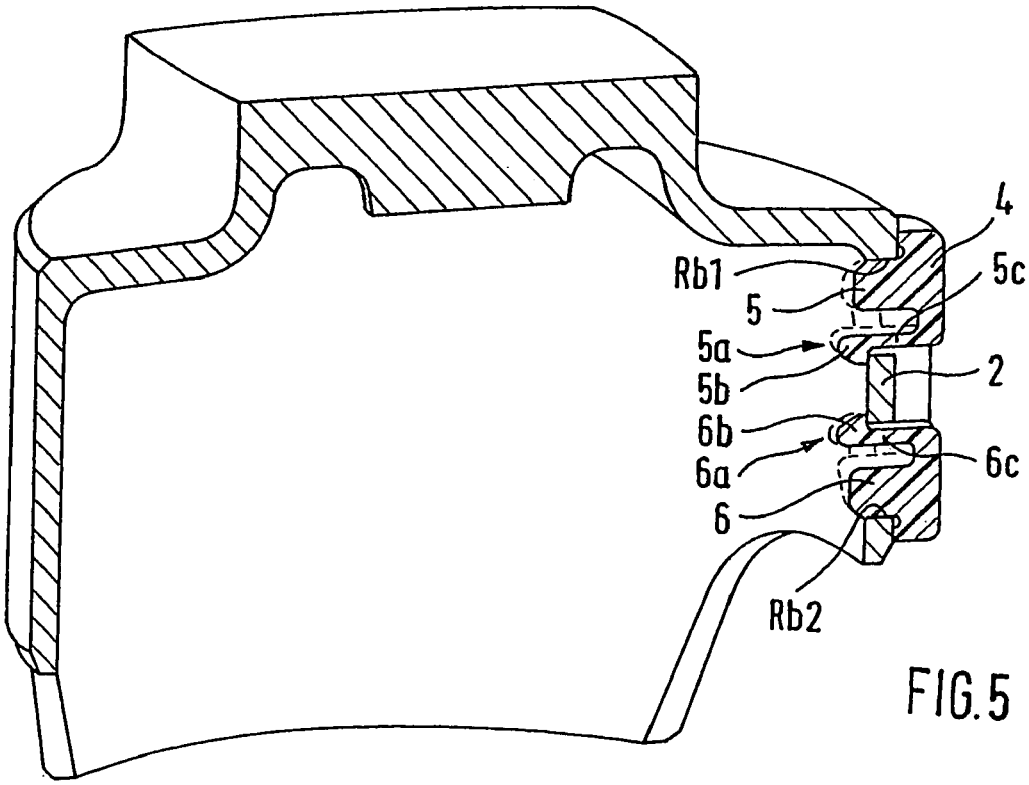
FIG. 5 is a perspective partial sectional view of the bucket tappet as well as the respective anti-rotation element of the valve tappet system according to a second embodiment of the present invention having catch mechanisms.

FIG. 5 shows another variant of an anti-rotation bucket tappet. In this embodiment, the anti-rotation element 4 is provided with fixation structure 5*a*, 6*a* which engage behind the lateral section 2 in the areas of the first and second engagement sections 5, 6.

The fixation structures 5*a*, 6*a* are configured as catch mechanisms, each having a catch structure 5*b*, 6*b* engaging behind the lateral section 2. Each catch structure 5*b*, 6*b* is mounted on an elastic flexible arm section 5*c*, 6*c* arranged in the respective assigned radial bore Rb1, Rb2 in the installed position.

Figure 6:
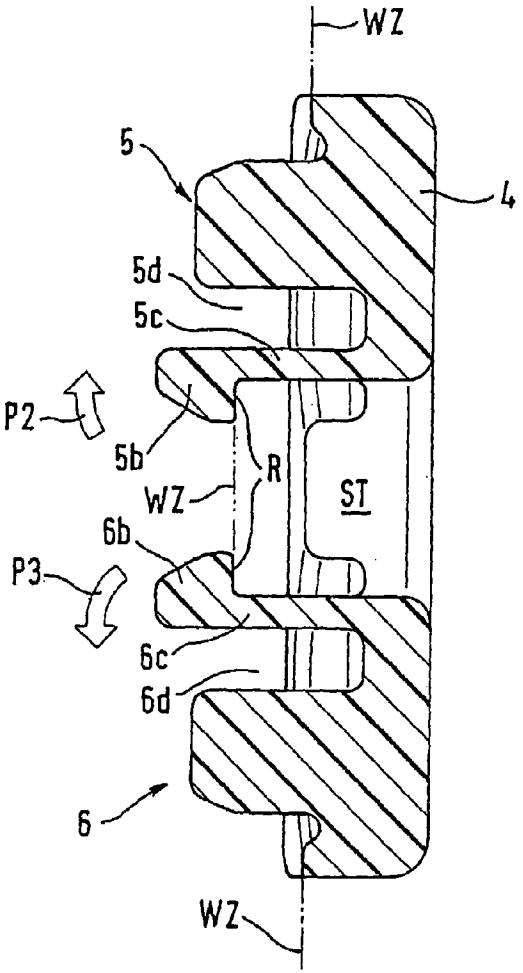
FIG. 6 is an axial sectional view to illustrate the configuration of the anti-rotation element according to FIG. 5.

FIG. 6 by itself shows the anti-rotation element according to FIG. 5 on an enlarged scale. The arrangement and configuration of the fixation structures 5*a*, 6*a* is such that the arm sections 5*c*, 6*c* are inside the enveloping circle defined by the radial bores Rb1, Rb2 (FIG. 5). The arm sections 5*c*, 6*c* are at first deflected as indicated by the arrows P2 and P3 when the anti-rotation element 4 is attached to the lateral section 2. As soon as the catch surfaces R provided by the catch structures 5*b*, 6*b* come to lie behind the inside surface of the lateral section 2, they are pinned back elastically into the illustrated position and engage thereby behind the area of the lateral section 2 defined by the radial bores Rb1, Rb2. To create adequate freedom of movement for the arm elements 5*c*, 6*c*, corresponding free slots 5*d*, 6*d* are provided in the insertion sections 5, 6.

The illustrated anti-rotation element 4 can be made of a plastic material by injection molding. The embodiment shown here can be manufactured by a non-gang mold because the mold wall of a mold which defines the catch area is itself defined by the end face of a ram which passes through a mold cavity provided to form the guide body per se, forming a ram opening ST. The path of a corresponding mold parting plane WZ is indicated by dash-dot lines in FIG. 6.

Figure 7:
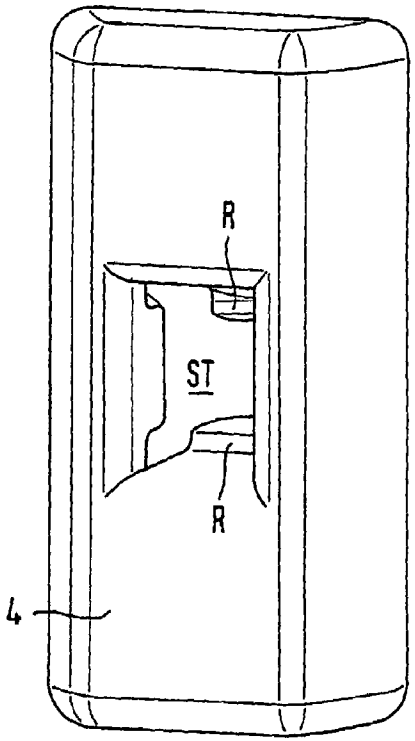
FIG. 7 is a perspective view of the anti-rotation element of the valve tappet system according to FIGS. 5 and 6.

FIG. 7 shows the anti-rotation element 4 according to FIG. 6 in a perspective view of the ram opening ST formed therein and the catch surfaces R situated therein. It is contemplated to insert an insertion element into this ram opening by which the catch mechanism is secured in the locked position.

As an alternative to the embodiment described above, it is also contemplated to implement a catch mechanism in some other way (e.g., by catch edges running around the end of the engagement sections 5, 6).

It is also further contemplated to reshape the engagement sections 5, 6 in the inner area of the lateral section 2 by a plastic in particular by ultrasonic melting. The catch structures can be configured so that the anti-rotation element 4 comes into catch engagement with the base body 1 with temporary elastic deformation, in particularly compression, bending or widening.

The radial bores Rb1, Rb2 provided on the base body 1 to accommodate the engagement elements of the anti-rotation element 4 on the base body 1 may serve as a tension surfaces or positioning surfaces as part of the manufacture of the base body 1, in particular in a grinding operation.

Although the present invention is described here in conjunction with a tappet device with which only an anti-rotation element is provided to accomplish a linear guidance according to this invention, it is also contemplated to provide several such anti-rotation elements arranged, e.g., with two diametrically opposed or otherwise arranged, preferably in an equidistant arrangement in the circumferential direction. The running play of the anti-rotation element in the respective guide groove can then be configured generously so that minor pivoting movements of the bucket tappet are possible, in particular in favor of an optimum alignment of the contact surfaces.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A valve tappet system comprising:

a base body, a lateral section forming a guide surface for guiding the base body along an oscillation axis, and an anti-rotation element configured to suppress a movement about said oscillation axis, wherein the anti-rotation element has a seat face which sits on the lateral section, a guide body which protrudes radially beyond the lateral section, a first engagement protrusion and a second engagement protrusion spaced from the first engagement protrusion in an oscillation direction and further wherein the lateral section has a first radial bore assigned to the first engagement protrusion and a second radial bore assigned to the second engagement protrusion, such that each of the first engagement and second engagement protrusions is engaged in the respective radial bore radially to the oscillation axis.

2. The valve tappet system as claimed in claim 1, wherein the first and second engagement sections are accommodated in the respective radial bores such that the anti-rotation element is substantially coupled without play with the lateral section in both the oscillation direction and in a circumferential direction of the lateral section.

3. The valve tappet system as claimed in claim 1, wherein the first and second engagement protrusions are cylindrical pins.

4. The valve tappet system as claimed in claim 3, wherein the cylindrical pins have substantially the same diameters.

5. The valve tappet system as claimed in claim 1, wherein the first and second engagement protrusions have a circular cross section in a sectional plane parallel to the oscillation axis.

6. The valve tappet system as claimed in claim 1, wherein a dimension of an area of the first or second engagement protrusion that is elevated above the seat face and protrudes toward the oscillation axis corresponds at least to the wall thickness of the lateral section.

7. The valve tappet system as claimed in claim 1, wherein the area of each of the first and second engagement protrusions and in the area of the second engagement protrusion, fixation structures that engagement behind the lateral section are respectively provided.

8. The valve tappet system as claimed in claim 7, wherein the fixation structures are catch mechanisms.

9. The valve tappet system as claimed in claim 8, wherein the catch mechanisms have a catch structure configured to engage behind the lateral section.

10. The valve tappet system as claimed in claim 9, wherein the catch structure is mounted on an elastically flexible arm section.

11. The valve tappet system as claimed in claim 10, wherein the arm section is arranged in the associated radial bore.

12. The valve tappet system as claimed in claim 1, wherein the anti-rotation element is configured to be brought into engagement with the base body with temporary elastic deformation.

13. The valve tappet system as claimed in claim 1, the guide body has a cross section in a circular segment shape in a sectional plane perpendicular to the oscillation axis.

14. The valve tappet system as claimed in claim 1, wherein the guide body is a plastic material.

15. The valve tappet system as claimed in claim 1, wherein the anti-rotation element is connectable to the base body in a loss-proof manner in an installed position.

16. The valve tappet system as claimed in claim 1, wherein the anti-rotation element is connectable to the base body in a form-fitting manner.

17. The valve tappet system as claimed in claim 16, wherein the form-fitting connection of the anti-rotation element to the base body is constituted by a reshaped end area of at least one of the engagement protrusions passing through the lateral section.

18. The valve tappet system as claimed in claim 17, wherein the reshaped end area is combined with at least one of the engagement protrusions being locally plastified.

19. The valve tappet system as claimed in claim 16, wherein the form-fitting connection of the anti-rotation element to the base body is constituted by a head section formed on at least one of the engagement sections passing through the lateral section.

20. The valve tappet system as claimed in of claim 1, wherein the anti-rotation element is integrally molded on the lateral section.

21. The valve tappet system as claimed in of claim 1, wherein the base body is provided with a head section having a cam contact zone.

22. The valve tappet system as claimed in claim 21, wherein the cam contact zone a curved cam contact surface.

23. The valve tapped system as claimed in claim 22, wherein the cam contact surface is cambered.

24. The valve tappet system as claimed in claims 1, wherein the valve tappet system forms a bucket tappet.

25. An anti-rotation element for a valve tappet system, comprising a seat face which sits on a lateral section, a guide body which protrudes radially beyond the lateral section, a first engagement protrusion and a second engagement protrusion spaced from the first engagement protrusion in an oscillation direction, wherein the lateral section has a first radial bore assigned to the first engagement protrusion and a second radial bore assigned to the second engagement protrusion, such that each of the first engagement and second protrusion is engaged in the respective radial bore in a direction radial to the oscillation axis.

26. A base body for a valve tappet system configured to cooperate with the anti-rotation element as claimed in claim 25.

* * * * *